US008248273B2

(12) United States Patent
Hayashi et al.

(10) Patent No.: US 8,248,273 B2
(45) Date of Patent: Aug. 21, 2012

(54) VEHICLE PRESENCE ALERT APPARATUS

(75) Inventors: Toshio Hayashi, Obu (JP); Toshiaki Nakayama, Nishikamo-gun (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 86 days.

(21) Appl. No.: 12/831,472

(22) Filed: Jul. 7, 2010

(65) Prior Publication Data

US 2011/0032122 A1 Feb. 10, 2011

(30) Foreign Application Priority Data

Aug. 5, 2009 (JP) ..... 2009-182101

(51) Int. Cl.
*G08G 1/04* (2006.01)

(52) U.S. Cl. ..... 340/943; 340/901; 340/902; 340/903; 340/435; 340/933; 381/302; 381/77

(58) Field of Classification Search ..... 340/943, 340/901, 902, 435, 903, 933; 367/99; 180/274; 280/735; 701/96, 93, 95, 300; 342/70, 71; 381/302, 77
See application file for complete search history.

(56) References Cited

U.S. PATENT DOCUMENTS

| | | | | |
|---|---|---|---|---|
| 4,396,268 | A * | 8/1983 | Shenk | 396/105 |
| 4,833,469 | A * | 5/1989 | David | 340/901 |
| 5,014,200 | A * | 5/1991 | Chundrlik et al. | 701/96 |
| 6,188,950 | B1 * | 2/2001 | Tsutsumi et al. | 701/96 |
| 6,212,129 | B1 * | 4/2001 | Nussbaumer et al. | 367/89 |
| 6,577,738 | B2 * | 6/2003 | Norris et al. | 381/77 |
| 6,580,374 | B2 * | 6/2003 | Schrage | 340/933 |
| 7,106,180 | B1 * | 9/2006 | Pompei | 340/384.7 |
| 7,463,165 | B1 * | 12/2008 | Hessing | 340/903 |
| 7,729,856 | B2 * | 6/2010 | Danz | 701/301 |
| 7,755,519 | B2 * | 7/2010 | Bonutti | 340/999 |
| 7,941,480 | B2 * | 5/2011 | Atsmon et al. | 709/202 |
| 7,990,287 | B2 * | 8/2011 | Bonutti | 340/999 |
| 8,009,844 | B2 * | 8/2011 | Whillock et al. | 381/124 |
| 2002/0101360 | A1 * | 8/2002 | Schrage | 340/901 |
| 2004/0020701 | A1 * | 2/2004 | Aoki | 180/274 |
| 2004/0084569 | A1 * | 5/2004 | Bonutti | 244/204 |
| 2004/0109575 | A1 * | 6/2004 | Thigpen | 381/302 |
| 2004/0114770 | A1 * | 6/2004 | Pompei | 381/77 |
| 2004/0247140 | A1 * | 12/2004 | Norris et al. | 381/77 |
| 2005/0156743 | A1 * | 7/2005 | Gallivan et al. | 340/573.4 |
| 2005/0207590 | A1 * | 9/2005 | Niehoff et al. | 381/77 |

(Continued)

FOREIGN PATENT DOCUMENTS

JP 52-11535 1/1977

(Continued)

*Primary Examiner* — Hoi Lau
(74) *Attorney, Agent, or Firm* — Nixon & Vanderhye PC

(57) ABSTRACT

A vehicle presence alert apparatus for alerting a target object to a presence of the vehicle via an alert sound with a frequency in an audible range is disclosed. The vehicle presence alert apparatus includes: a sound emitter configured to (i) cause a carrier wave with a frequency in an ultrasonic range to carry the alert sound, and (ii) emit the carrier wave carrying the alert sound as a radiation wave toward the target object; a sound receiver configured to receive a reflected wave, the reflected wave being generated due to reflection of the radiation wave by the target object; and relative velocity calculation means for calculating a relative velocity of the target object with respect to the vehicle based on a frequency of the radiation wave and a frequency of the reflected wave.

6 Claims, 2 Drawing Sheets

U.S. PATENT DOCUMENTS

| | | | | |
|---|---|---|---|---|
| 2006/0077049 | A1* | 4/2006 | Kato et al. | 340/435 |
| 2006/0192669 | A1* | 8/2006 | Allen | 340/522 |
| 2007/0109176 | A1* | 5/2007 | Nakanishi et al. | 342/70 |
| 2007/0182587 | A1* | 8/2007 | Danz | 340/903 |
| 2007/0257783 | A1 | 11/2007 | Matsumoto et al. | |
| 2010/0128568 | A1* | 5/2010 | Han et al. | 367/99 |
| 2010/0231368 | A1* | 9/2010 | Nakayama et al. | 340/425.5 |
| 2011/0032087 | A1* | 2/2011 | Nakayama et al. | 340/384.1 |
| 2011/0032122 | A1* | 2/2011 | Hayashi et al. | 340/943 |
| 2011/0175713 | A1* | 7/2011 | Nakayama | 340/435 |
| 2011/0181442 | A1* | 7/2011 | Nakayama | 340/933 |
| 2011/0304445 | A1* | 12/2011 | Nakayama | 340/425.5 |

FOREIGN PATENT DOCUMENTS

| | | |
|---|---|---|
| JP | 56-128242 | 10/1981 |
| JP | 56-135352 | 10/1981 |
| JP | 9-99792 | 4/1997 |
| JP | 10-201001 | 7/1998 |
| JP | 2007-182195 | 7/2007 |
| JP | 2007-237831 | 9/2007 |
| JP | 2007-328603 | 12/2007 |
| JP | 2008-273251 | 11/2008 |

* cited by examiner

VEHICLE PRESENCE ALERT APPARATUS

CROSS REFERENCE TO RELATED APPLICATION

The present application is based on Japanese Patent Application No. 2009-182101 filed on Aug. 5, 2009, disclosure of which is incorporated herein by reference.

BACKGROUND

1. Field of the Invention

The present invention relates to a vehicle presence alert apparatus for informing the presence of a vehicle.

2. Description of Related Art

Vehicles driven by an electric motor such as electric vehicles and hybrid vehicles are increasing recently. Because a vehicle driven by an electric motor travels quietly as compared to a vehicle driven by an internal combustion engine, a pedestrian or the like may not notice the presence of the vehicle. In this relation, a vehicle presence alert apparatus is known. A conventional vehicle presence alert apparatus emits an alert sound such as pseudo engine sound and the like from a speaker mounted to the vehicle, thereby alerting a pedestrian or the like in front of the vehicle to the presence of the vehicle (see JP-H10-201001A and JP-2006-199110A corresponding US-2007/0257783A for instance).

If an alert sound is emitted in a simple way, because the alert sound is diffused to the environment and attenuated, a high capacity speaker is required to alert the environment to the presence of the vehicle. However, it is typically difficult to mount the high capacity speaker to the vehicle. Moreover, if the high capacity speaker is used to emit an alert sound, a person (e.g., a passenger in a vehicle compartment) who needs not to recognize the presence of the vehicle may hear the alert sound and may have an uncomfortable feeling.

JP-2007-182195A discloses a vehicle presence alert system including a vehicle presence alert apparatus mounted to a vehicle and a notification apparatus wearable by a pedestrian. The vehicle presence alert apparatus transmits radio wave for alert in addition to the alert sound. The notification apparatus worn by the pedestrian receives the radio wave for alert and causes the pedestrian to tactilely or visually recognize the presence of the vehicle. In order for the vehicle presence alert system to enable the recognition of the presence of the vehicle, the vehicle needs to have a transmitter for transmitting the radio wave. Further, a pedestrian and the like need to wear a receiver for receiving the radio wave and a perception device for operating in response to the reception of the radio wave. Thus, the above vehicle presence alert system involves complicated and inconvenient management.

SUMMARY

In view of the above and other difficulties, it is an objective of the present invention to provide a vehicle presence alert apparatus that is capable of informing a presence of a vehicle via an alert sound without using a high capacity speaker.

According to an aspect of the present invention, there is provided a vehicle presence alert apparatus for alerting a target object to a presence of a vehicle via an alert sound with a frequency in an audible range. The vehicle and the target object are movable relative to each other. The vehicle presence alert apparatus includes: a sound emitter configured to (i) cause a carrier wave with a frequency in an ultrasonic range to carry the alert sound, and (ii) emit the carrier wave carrying the alert sound as a radiation wave toward the target object; a sound receiver configured to receive a reflected wave generated from reflection of the radiation wave by the target object; and relative velocity calculation means for calculating a relative velocity of the target object with respect to the vehicle based on a frequency of the radiation wave and a frequency of the reflected wave.

According to the above, the sound emitter can act as a so-called parametric speaker, which allows the radiation wave to be self-demodulated and audible at a place corresponding to the frequency of the carrier wave. Thus, the vehicle presence alert apparatus can provide the alert sound with a remarkably high directivity, and can inform the presence of the vehicle via the alert sound without using a high capacity speaker. Further, because the relative velocity calculation means calculates the relative velocity of the target object with respect to the vehicle, the vehicle presence alert apparatus can allow an alert manner to be changeable in accordance with the relative velocity.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF EXEMPLARY EMBODIMENTS

A vehicle presence alert apparatus 1 of one embodiment will be described below with reference to the accompanying drawings.

The vehicle presence alert apparatus 1 is mounted to, for example, a vehicle that travels quietly and brings a possibility that a pedestrian or the like cannot recognize the presence of the vehicle. For example, the vehicle presence alert apparatus 1 is mounted to a vehicle driven by a motor such as an electric vehicle, a hybrid vehicle and the like to inform the presence of the vehicle to a target object 2 (e.g., a pedestrian), which is movable relative to the vehicle.

Figure 1A:
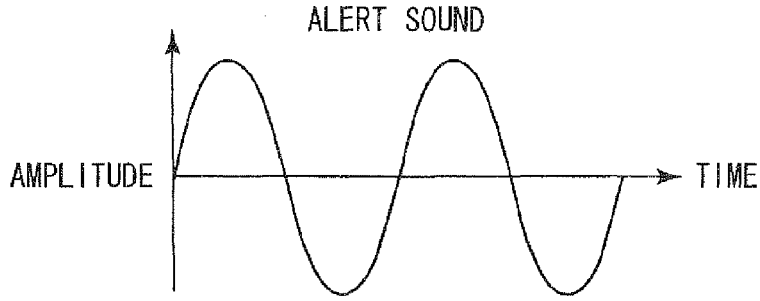
FIG. 1A is a waveform diagram illustrating an alert sound.
Figure 1B:
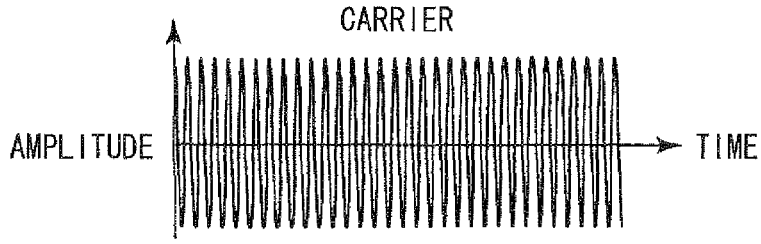
FIG. 1B is a waveform diagram illustrating a carrier wave.
Figure 1C:
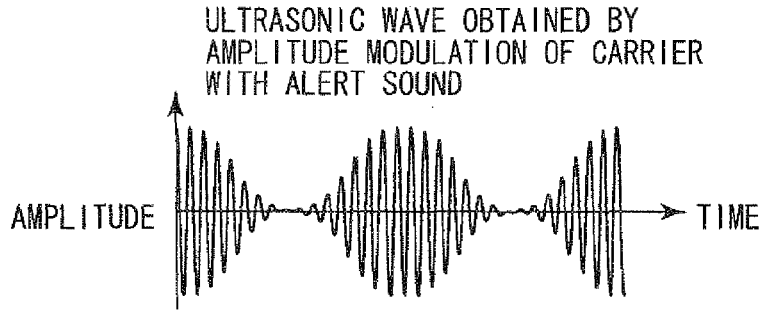
FIG. 1C is a waveform diagram illustrating an ultrasonic wave obtained by amplitude modulation of the carrier wave with the alert sound.

The vehicle presence alert apparatus 1 generates an alert sound (see FIG. 1A) with a frequency in an audible range and a carrier wave (see FIG. 1B) with a frequency in an ultrasonic range so that the carrier wave carries the alert sound, and the vehicle presence alert apparatus 1 radiates the carrier wave carrying the alert sound as an ultrasonic wave to air. The vehicle presence alert apparatus 1 uses a principle of a so-called "parametric speaker". More specifically, a sound wave radiated from the vehicle presence alert apparatus 1 is an ultrasonic wave which is obtained by amplitude modulation of the carrier wave with the alert sound (see FIG. 1C). Because the vehicle presence alert apparatus 1 uses the ultrasonic wave as a radiation wave, the vehicle presence alert apparatus 1 can feature a high directivity regarding a radiation direction of the alert sound.

Figure 1D:
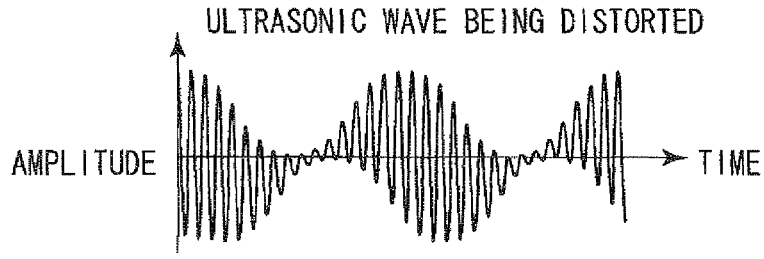
FIG. 1D is a waveform diagram illustrating the ultrasonic wave being strained.
Figure 1E:
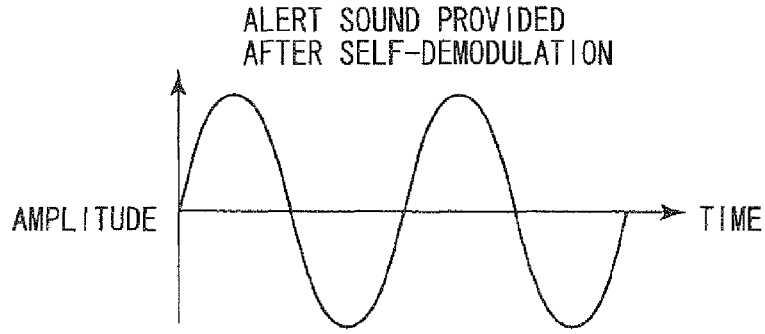
FIG. 1E is a waveform diagram illustrating the alert sound provided after self-demodulation.

The ultrasonic wave radiated from the vehicle presence alert apparatus 1 is distorted (FIG. 1D) while propagating through the air due to such a non-linear property of air that a time taken for air expansion after air compression is longer than a time taken for the air compression. Then, the ultrasonic wave carrying the alert sound is self-demodulated and the alert sound is audible (see FIG. 1E) at a place corresponding to the frequency of the carrier wave.

Figure 2A:
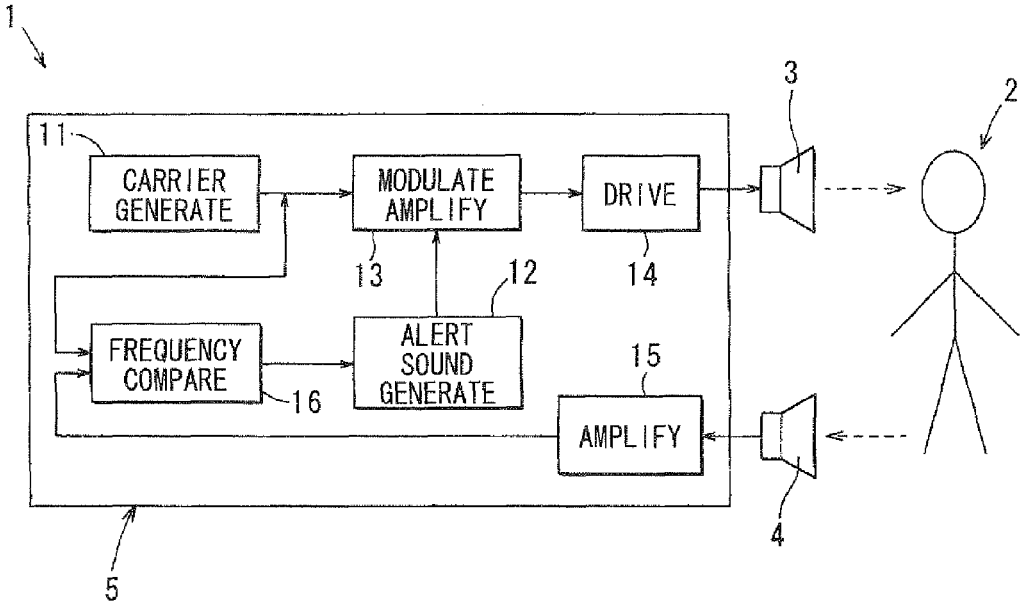
FIG. 2A is a diagram illustrating a configuration of a vehicle presence alert apparatus.

As shown in FIG. 2A for example, the vehicle presence alert apparatus 1 includes a sound emitter 3, a sound receiver 4 and a controller 5. The sound emitter 3 emits the alert sound toward the target object 2. The sound receiver 4 receives a reflected wave, which is generated due to sound reflection at the target object 2. The controller 5 controls an electric signal input/output between the controller 5 and the sound emitter 3 and between the controller 5 and the sound receiver 4.

Figure 2B:
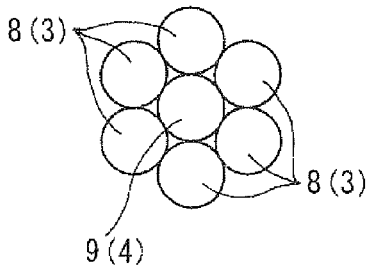
FIG. 2B is a diagram illustrating a configuration of a sound emitter and a sound receiver.

The sound emitter 3 uses a principle of a parametric speaker as described above. The sound emitter 3 causes the carrier wave with a frequency in an ultrasonic range to carry the alert sound, and emits the carrier wave carrying the alert sound as a radiation wave toward the target object 2. The sound emitter 3 is configured as a speaker array including multiple speakers 8, as shown in FIG. 2B for instance. A transducer of each speaker 8 converts the electric signal, which is outputted from the controller 5 and may be a voltage signal, into mechanical oscillation. The speaker 8 uses the mechanical oscillation to generate a sound wave with a frequency in an ultrasonic range.

For example, the multiple speakers 8 are arranged so that the multiple transducers have the same oscillation direction, and the multiple transducers are positioned on the same plane. Each transducer for sound wave generation may include, for example, two electrodes spaced apart by a predetermined spatial interval, a piezoelectric element having a free end at one end thereof and a fixed end at another end thereof, or the like.

If the transducer includes two electrodes, the transducer generates a sound wave in the following way. Voltage application between the two electrodes and stop of the voltage application between the two electrodes are repeated. In this case, a Coulomb force repeatedly generates and disappears between the two electrodes. The generation and disappearance of the Coulomb force oscillates one of the electrodes, and generates a sound wave. If the transducer includes the piezoelectric element, the transducer generates a sound wave in the following way. Voltage application to the piezoelectric element and stop of the voltage application to the piezoelectric element are repeated. In this case, an expansion force repeatedly generates and disappears in the piezoelectric element. The generation and disappearance of the expansion force oscillates the free end of the piezoelectric element and generates a sound wave.

The sound receiver 4 receives a reflected wave, which is generated when the radiation wave emitted from the sound emitter 3 is reflected by the target object 2. As shown in FIG. 2B, the sound receiver 4 includes a speaker 9, a configuration of which may be similar to that of the speaker 8 of the sound emitter 3. Together with the speakers 8 of the sound emitter 3, the speaker 9 of the sound receiver 4 forms a speaker array. The transducer of the speaker 9 and the transducers of the speakers 8 are arranged to have the same oscillation direction and are arranged on the same plane. The transducer of the speaker 9 converts the reflected wave received therewith from mechanical oscillation into an electric signal such as voltage signal and the like, and outputs the electric signal to the controller 5.

The controller 5 includes a CPU (central processing unit) having a control function and a computation function, a storage device such as ROM (read-only memory), RAM (random access memory) and the like, an input device, an output device, and the like. The controller 5 may have a known structure including the foregoing components.

The controller 5 is configured to include or act as a carrier wave generation unit 11, an alert sound generation unit 12, a modulation amplification unit 13, a drive circuit unit 14, an amplification unit 15, a frequency comparison unit 16, and the like. The carrier wave generation unit 11 generates a signal oscillating at a frequency in an ultrasonic range. The alert sound generation unit 12 generates a signal representative of a waveform of the alert sound. The modulation amplification unit 13 amplitude-modulates and amplifies the signal created by the carrier wave generation unit 11. The drive circuit unit 14 applies the electric signals such as voltage signals and the like to the transducers of the speakers 8 based on the signal outputted from the modulation amplification unit 13. The amplification unit 15 amplifies the electric signal inputted from the speaker 9. The frequency comparison unit 16 compares (i) a frequency of the signal outputted from the carrier wave generation unit 11 with (ii) a frequency of the signal outputted from the amplification unit 15.

The frequency comparison unit 16 compares (i) a frequency of the radiation wave with (ii) a frequency of the reflected wave, by comparing (i) a frequency of the signal outputted from the carrier wave generation unit 11 with (ii) a frequency of the signal outputted from the amplification unit 15. The frequency comparison unit 16 outputs a signal indicative of a result of the comparison. Based on the signal indicative of the result of the comparison from the frequency comparison unit 16, the alert sound generation unit 12 calculates a relative velocity of the target object 2 with respect to the vehicle. In accordance with a result of the calculation of the relative velocity, the alert sound generation unit 12 changes or switches the frequency of the alert sound to be generated, and generates the signal representative of the waveform of the alert sound.

As can be seen from the above, the alert sound generation unit 12 and the frequency comparison unit 16 can act as relative velocity calculation means for calculating a relative velocity of the target object 2 with respect to the vehicle based on the frequency of the radiation wave and the frequency of the reflected wave. The alert sound generation unit 12 can act as alert sound frequency changing or switching means for changing or switching the frequency of the alert sound in accordance with the relative velocity. In the above, the relative velocity calculation means calculates the relative velocity based on Doppler effect.

For example, the alert sound generation unit 12 increases the frequency of the alert sound as the relative velocity is larger and a rate of decrease in relative distance between the vehicle and the target object 2 with time is larger. In this configuration, a pedestrian or the like, which is an example of the target object 2, hears the alert sound with a higher frequency as the vehicle rapidly approaches the pedestrian or the like.

In the above exemplary configuration, the vehicle presence alert apparatus 1 includes the sound emitter 3, the sound receiver 4, the frequency comparison unit 16, and the alert sound generation unit 12. The sound emitter 3 causes the carrier wave with the frequency in the ultrasonic range to carry the alert sound, and emits the carrier wave carrying the alert sound as the radiation wave toward the target object 2. The sound receiver 4 receives the reflected wave generated from the reflection of the radiation wave by the target object 2. The frequency comparison unit 16 compares the frequency of the radiation wave with the frequency of the reflected wave. The alert sound generation unit 12 generates the signal having the waveform of the alert sound. The alert sound generation unit 12 calculates the relative velocity of the target object 2 with respect to the vehicle based on the result of the comparison made by and outputted from the frequency comparison unit 16, and changes or switches the frequency of the alert sound in accordance with the calculation result of the relative velocity.

According to the above configuration, the sound emitter 3 functions as so called a parametric speaker, which allows the radiation wave to be self-demodulated and audible at a place corresponding to the frequency of the carrier wave. Because of this, the vehicle presence alert apparatus 1 can provide the alert sound with a remarkable high directivity, and the vehicle presence alert apparatus 1 can thus inform the presence of the vehicle via the alert sound without using a high capacity speaker.

Moreover, according to the above vehicle presence alert apparatus 1, the alert sound generation unit 12 and the frequency comparison unit 16 allow the frequency of the alert sound to be variable in accordance with the relative velocity. Because of this configuration, when the relative velocity is large and when a rate of decrease in relative distance between the vehicle and the target object with time is large for example, the above vehicle presence alert apparatus 1 can inform such rapid approach of the vehicle by increasing the frequency of the alert sound.

The above embodiment can be modified in various ways, examples of which will be described below.

In the above embodiment, the alert sound generation unit 12 can act as the alert sound frequency changing or switching means for changing or switching the frequency of the alert sound in accordance with the relative velocity. The alert sound generation unit 12 may act as emission stop period control means for controlling stop of the emission of the radiation wave when the emission of the radiation wave is regularly stopped. More specifically, the alert sound generation unit 12 may act as emission stop period control means for controlling the emission of the radiation wave such that the alert sound generation unit 12 lengthens and shortens a period of the stop of the emission of the radiation wave in accordance with the relative velocity when the emission of the radiation wave is regularly stopped.

According to the above alternative configuration, when the relative velocity is large and a rate of decrease in relative distance between the vehicle and the target object with time is large, the vehicle presence alert apparatus 1 can inform the rapid approach of the vehicle by, for example, shortening the period during which the emission of the radiation wave is stopped. It should be noted that the vehicle presence alert apparatus 1 can employ a variety of configurations for allowing an alert manner to be variable in accordance with the relative velocity. In other words, a configuration for allowing an alert manner to be variable in accordance with the relative velocity is not limited to the above alert frequency changing or switching means and the above emission stop period control means.

In the above embodiment, the speakers 8 of the sound emitter 3 emit a sound wave, and the speaker 9 of the sound receiver 4 receives the sound wave. Alternatively, each of or one of the speakers 8 and the speaker 9 may be configured to emit and receive a sound wave, and the speakers 8 and the speaker 9 may constitute a sound transceiver having the above-described functions of the sound emitter 3 and the sound receiver 4. Further, the sound transceiver may alternately function as the sound emitter 3 and the sound receiver 4 at predetermined time intervals, or may simultaneously function as the sound emitter 3 and the sound receiver 4.

According to an aspect of the present disclosure, there is provided a vehicle presence alert apparatus for alerting a target object to a presence of a vehicle via an alert sound with a frequency in an audible range. The vehicle and the target object are movable relative to each other. The vehicle presence alert apparatus includes: a sound emitter configured to (i) cause a carrier wave with a frequency in an ultrasonic range to carry the alert sound, and (ii) emit the carrier wave carrying the alert sound as a radiation wave toward the target object; a sound receiver configured to receive a reflected wave, the reflected wave being generated due to reflection of the radiation wave by the target object; and relative velocity calculation means for calculating a relative velocity of the target object with respect to the vehicle based on a frequency of the radiation wave and a frequency of the reflected wave.

According to the above vehicle presence alert apparatus, the sound emitter functions as a so-called "paramedic speaker", which makes the emitted sound wave(i.e., the radiation wave) self-demodulated and audible at a place corresponding to the frequency of the carrier wave. Thus, the above vehicle presence alert apparatus can provide the alert sound with a remarkably high directivity, and therefore can inform the presence of the vehicle via the alert sound without using a high capacity speaker.

Furthermore, because the relative velocity calculation means can calculate and recognize the relative velocity of the target object, to which the presence of the vehicle is to be informed, with respect to the vehicle, it is possible to allow an alert manner to be changeable in accordance with the relative velocity. For example, when the relative velocity is large and when a rate of decrease in relative distance between the vehicle and the target object with time is large, the above vehicle presence alert apparatus may alert the target object that the vehicle is rapidly approaching the target object, by increasing the frequency of the alert sound or by shortening a period during which emission of the radiation wave is stopped.

The above vehicle presence alert apparatus may be configured to further include alert sound frequency changing means for changing the frequency of the alert sound in accordance with the calculated relative velocity. This configuration is an example of a configuration for allowing the alert manner to be changeable in accordance with the relative velocity. According this configuration, when the relative velocity is large and when a rate of decrease in relative distance between the vehicle and the target object with time is large, the vehicle presence alert apparatus can inform such rapid approach of the vehicle to the target object by, for example, increasing the frequency of the alert sound.

The above vehicle presence alert apparatus may be configured to further include emission stop period control means for controlling emission of the radiation wave from the sound emitter, such that: when regularly stopping the emission of the radiation wave, the emission stop period control means lengthens and shortens a period of stop of the emission of the radiation wave in according with the calculated relative velocity. This configuration is another example of a configuration for allowing the alert manner to be changeable in accordance with the relative velocity. According to this configuration, when the relative velocity is large and when a rate of decrease in relative distance between the vehicle and the target object with time is large, the vehicle presence alert apparatus can inform the rapid approach of the vehicle by, for example, shortening the period during which the emission of the radiation wave is stopped.

While the invention has been described above with reference to various embodiments thereof, it is to be understood that the invention is not limited to the above described embodiments and constructions. The invention is intended to cover various modifications and equivalent arrangements. In addition, while the various combinations and configurations described above are contemplated as embodying the invention, other combinations and configurations, including more, less or only a single element, are also contemplated as being within the scope of embodiments.

What is claimed is:

1. A vehicle presence alert apparatus for alerting a target object, which is movable relative to a vehicle, to a presence of the vehicle via an audible alert sound with a frequency in an audible range, the vehicle presence alert apparatus comprising:

a sound emitter that causes a carrier wave with a frequency in an ultrasonic range to carry the alert sound with a frequency in an audible range, and that emits the ultrasonic carrier wave carrying the audible frequency alert sound as an air pressure radiation wave toward the target object;

an air pressure wave receiver that receives a reflected air pressure wave generated by reflection of the radiation wave from the target object; and a controller that calculates a relative velocity of the target object with respect to the vehicle based on a frequency of the emitted radiation wave and a frequency of the reflected wave.

2. The vehicle presence alert apparatus according to claim 1, wherein:

the controller changes the frequency of the audible alert sound in accordance with the relative velocity.

3. The vehicle presence alert apparatus according to claim 2, wherein:

the controller compares (i) the frequency of the emitted radiation wave with (ii) the frequency of the received reflected wave in at least one of the audible range and the ultrasonic range, thereby calculating the relative velocity of the target object with respect to the vehicle; and as the relative velocity and a rate of decrease in relative distance between the vehicle and the target object with time become larger, the controller increases the audible range frequency of the audible alert sound to alert the target object to rapid approach of the vehicle.

4. The vehicle presence alert apparatus according to claim 1, wherein the sound emitter comprises a parametric speaker.

5. A vehicle presence alert apparatus for alerting a target object, which is movable relative to a vehicle, to a presence of the vehicle via an alert sound with a frequency in an audible range, the vehicle presence alert apparatus comprising:

a sound emitter that causes a carrier wave with a frequency in an ultrasonic range to carry the alert sound, and that emits the carrier wave carrying the alert sound as a radiation wave toward the target object;

a sound receiver that receives a reflected wave generated from reflection the radiation wave by the target object; and a controller that calculates a relative velocity of the target object with respect to the vehicle based on a frequency of the radiation wave and a frequency of the reflected wave wherein when regularly stopping emission of the radiation wave, the controller lengthens and shortens a period of stop of the emission of the radiation wave in accordance with the relative velocity.

6. The vehicle presence alert apparatus according to claim 5, wherein:

the controller compares (i) the frequency of the emitted radiation wave with (ii) the frequency of the received reflected wave in at least one of the audible range and the ultrasonic range, thereby calculating the relative velocity of the target object with respect to the vehicle; and as the relative velocity and a rate of decrease in relative distance between the vehicle and the target object with time become larger, the controller shortens a period of stopping the emission of the radiation wave to alert the target object to rapid approach of the vehicle.

* * * * *